US007793568B2

(12) United States Patent
Mitcheltree et al.

(10) Patent No.: US 7,793,568 B2
(45) Date of Patent: Sep. 14, 2010

(54) RATCHET MECHANISM

(75) Inventors: Jeff Mitcheltree, Cuyahoga Falls, OH (US); John Horvath, Cuyahoga Falls, OH (US)

(73) Assignee: NMTC, Inc., Stow, OH (US)

( * ) Notice: Subject to any disclaimer, the term of this patent is extended or adjusted under 35 U.S.C. 154(b) by 89 days.

(21) Appl. No.: 12/174,326

(22) Filed: Jul. 16, 2008

(65) Prior Publication Data

US 2010/0011913 A1 Jan. 21, 2010

(51) Int. Cl.
*B25B 13/46* (2006.01)

(52) U.S. Cl. ..... 81/57.39

(58) Field of Classification Search ..... 81/57.39
See application file for complete search history.

(56) References Cited

U.S. PATENT DOCUMENTS 4,722,252 A * 2/1988 Fulcher et al. ..... 81/57.39
4,791,836 A * 12/1988 D'Haem et al. ..... 81/57.39
5,896,789 A * 4/1999 Giardino ..... 81/57.39
5,967,002 A * 10/1999 Pijanowski ..... 81/57.39
6,044,731 A 4/2000 Hsieh
6,209,422 B1 4/2001 Kamiya et al.
6,305,246 B1 10/2001 Horvath
6,490,953 B2 12/2002 Horvath
7,121,169 B1 10/2006 Larson
2007/0028724 A1 * 2/2007 Albertson et al. ..... 81/57.39

OTHER PUBLICATIONS

Chicago Pneumatic Tool Division, Auto Tool 681, Third Edition, 2 pages (May 1987).

* cited by examiner

*Primary Examiner*—David B Thomas
(74) *Attorney, Agent, or Firm*—Hahn Loeser & Parks LLP

(57) ABSTRACT

A ratchet wrench assembly having a spring assembly positioned in the ratchet head. The ratchet wrench has a handle portion, a head portion with a yoke having yoke teeth, a ratchet mechanism drive body positioned in the head portion, and one or more pawls positioned in the drive body. The yoke is capable of reciprocating between movement with the pawls of the drive body operatively engaging the yoke teeth and movement with the pawls of the drive body disengaged from the yoke teeth. The spring assembly is positioned in the drive body and is capable of retaining the drive body in position when the yoke reciprocates from a first direction to a second direction.

20 Claims, 6 Drawing Sheets

RATCHET MECHANISM

BACKGROUND AND SUMMARY OF THE DISCLOSURE

The present disclosure relates to ratchet wrenches. Ratchet wrenches typically embody a handle portion and a head portion, wherein the head portion houses a ratchet mechanism capable of rotating about an axis. A drive motor may be positioned in the handle portion to drive the ratchet mechanism. These drive motors may be pneumatic, however other motors may also be utilized.

A ratchet drive may be positioned within the head portion and includes a square drive on which sockets may be attached. The head portion may house a reciprocating yoke capable of rotating the ratchet mechanism. The yoke reciprocates between movement in a first direction and movement in a second direction opposite the first direction to turn the ratchet mechanism. The yoke may comprise gear cogs, teeth, serrations, or other engagement portions, herein referred to generally as yoke teeth. Additionally, the ratchet mechanism may include one or more pawls pivotally positioned within the head and capable of selectively engaging the yoke teeth when the reciprocating yoke moves in the first direction and ratcheting over the yoke teeth when the yoke moves in the second direction opposite the first direction. In reversing ratchet wrenches, the pawl may be selectively engageable with the yoke teeth when the yoke moves in the first direction or the second direction enabling clockwise or counterclockwise rotation of the drive member respectively.

When the yoke moves engaged with the pawl in the first direction, the ratchet drive rotates about its axis in the first direction. Then, when the yoke moves in the second direction, the pawl ratchets over the yoke and the ratchet drive mechanism may be held in position relative to the head portion. While the yoke moves in the second direction, certain ratchet wrenches may keep the ratchet drive in place using a spring. The spring creates a frictional force that is typically referred to as head tension or tension. In the past, coil springs, wave springs or wave washers, and Bellville washers have been used to urge the ratchet mechanism against a portion of the head to provide head tension.

For coil springs, the amount of tension in the head portion of the ratchet wrench may be increased by either increasing the outside diameter of the coil spring and/or increasing the wire size, increasing the spring constant. However, the increase in the diameter of a coil spring, which may be caused by an increase in wire size, may require an increase in the diameter of the recess in which the spring is positioned in the ratchet drive mechanism. Increasing the diameter of the recess in the ratchet drive mechanism may weaken the area around the recess, causing increased stress on the ratchet mechanism.

The disclosed ratchet wrench mechanism maintains a greater tension or frictional force in the head portion of the ratchet wrench without increasing the diameter of the coil spring or size of the recess in the body of the ratchet mechanism. Further, the presently disclosed spring assembly in the ratchet wrench maintains a more stable force throughout the life of the tool and prolongs the life of the tool.

The ratchet wrench of the present disclosure comprising a handle portion, a head portion operably connected to the handle portion, a drive body comprising at least one pawl and at least one spring aperture positioned in the head portion, a yoke comprising a plurality of teeth positioned within the head portion capable of reciprocating between a first direction with the at least one pawl operatively engaging one or more teeth and a second direction with the at least one pawl disengaged from the teeth. The ratchet may further comprise a spring assembly positioned in at least one spring aperture capable of retaining the drive body relative to the head portion when the yoke reciprocates in the second direction with the at least one pawl disengaged from the teeth. The spring assembly may comprise a spring and a stabilizer cooperatively positioned with the spring.

DETAILED DESCRIPTION OF THE DRAWINGS

Figure 1:
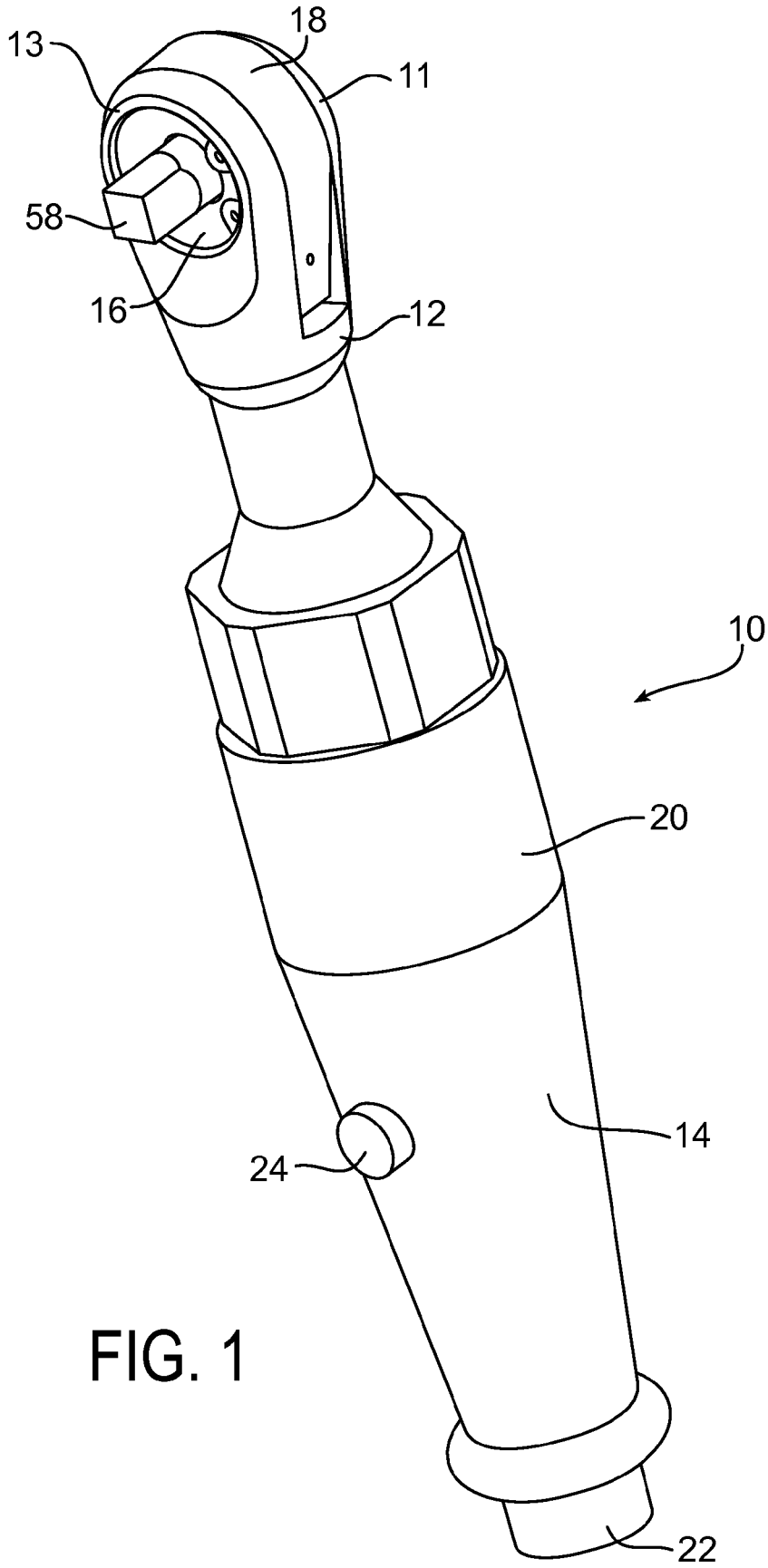
FIG. 1 is a perspective view of the ratchet wrench.
Figure 2:
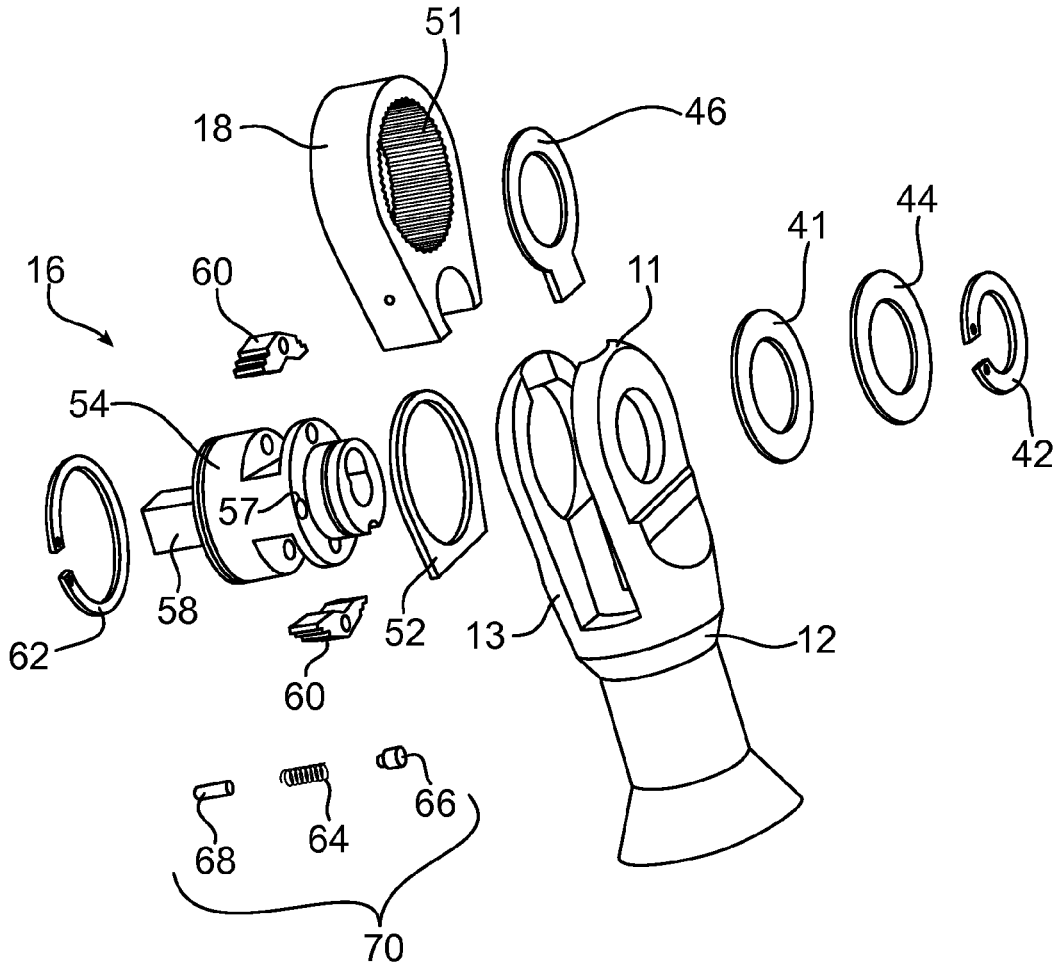
FIG. 2 is an exploded perspective view of a ratchet assembly and head portion of FIG. 1.

Referring now to FIG. 1, a ratchet wrench assembly 10 includes a head portion 12 operably connected to a handle portion 14. The head portion 12 adjacent to the handle portion 14 may be manufactured integral to the handle portion 14 or made as a separate piece and attached to the handle portion 14. The head portion 12 as shown in FIGS. 1 and 2 is a dual ear configuration having a first ear 11 and a second ear 13. A bore may be formed through the ears 11, 13 to allow for placement of a yoke 18 and a ratchet mechanism 16 as described below. The handle portion 14 includes a housing 20 that encloses a drive motor, not shown. The drive motor may be a pneumatic drive motor. Alternatively, other motors such as electric motors or hydraulic motors may be used to drive the ratchet wrench assembly 10. When the motor is pneumatic, the handle portion 14 has an air inlet port 22 for connection to a compressed air supply. The ratchet wrench 10 further includes an actuator 24 allowing the operator to actuate the pneumatic motor, causing the yoke 18 to reciprocate to drive the ratchet mechanism 16. The actuator 24 may be a button as shown, a lever, or any other type of device capable of actuating a valve or switch to control the drive motor.

Figure 3:
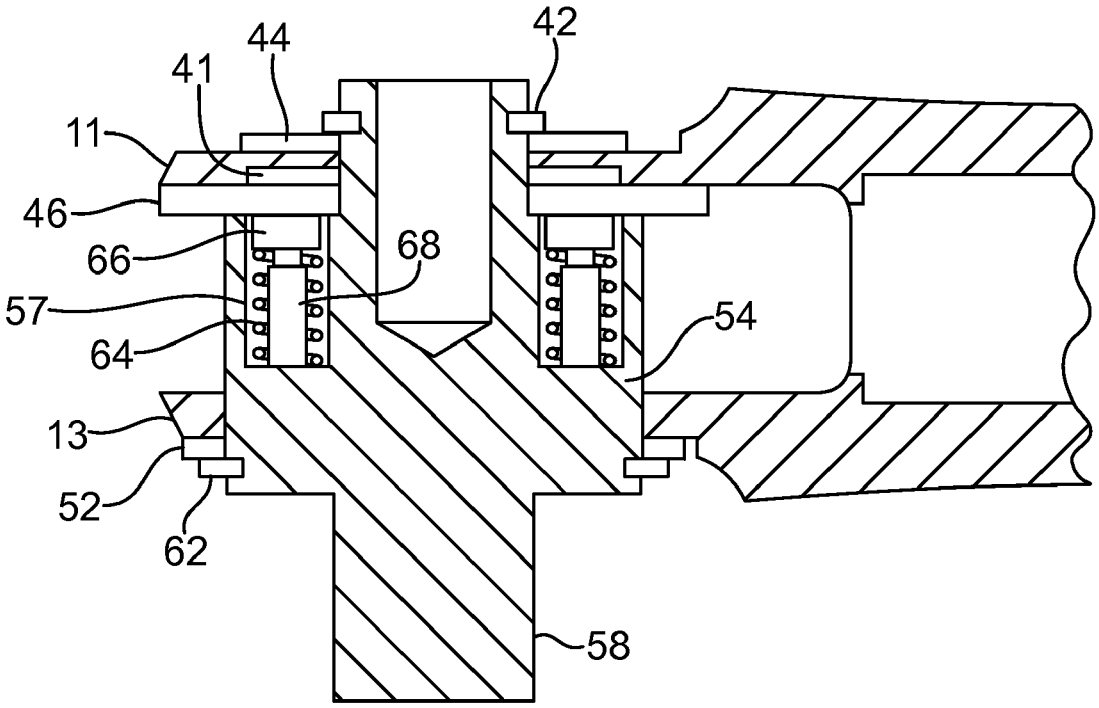
FIG. 3 is a partial diagrammatical cross sectional view of a ratchet mechanism in the head portion.
Figure 4:
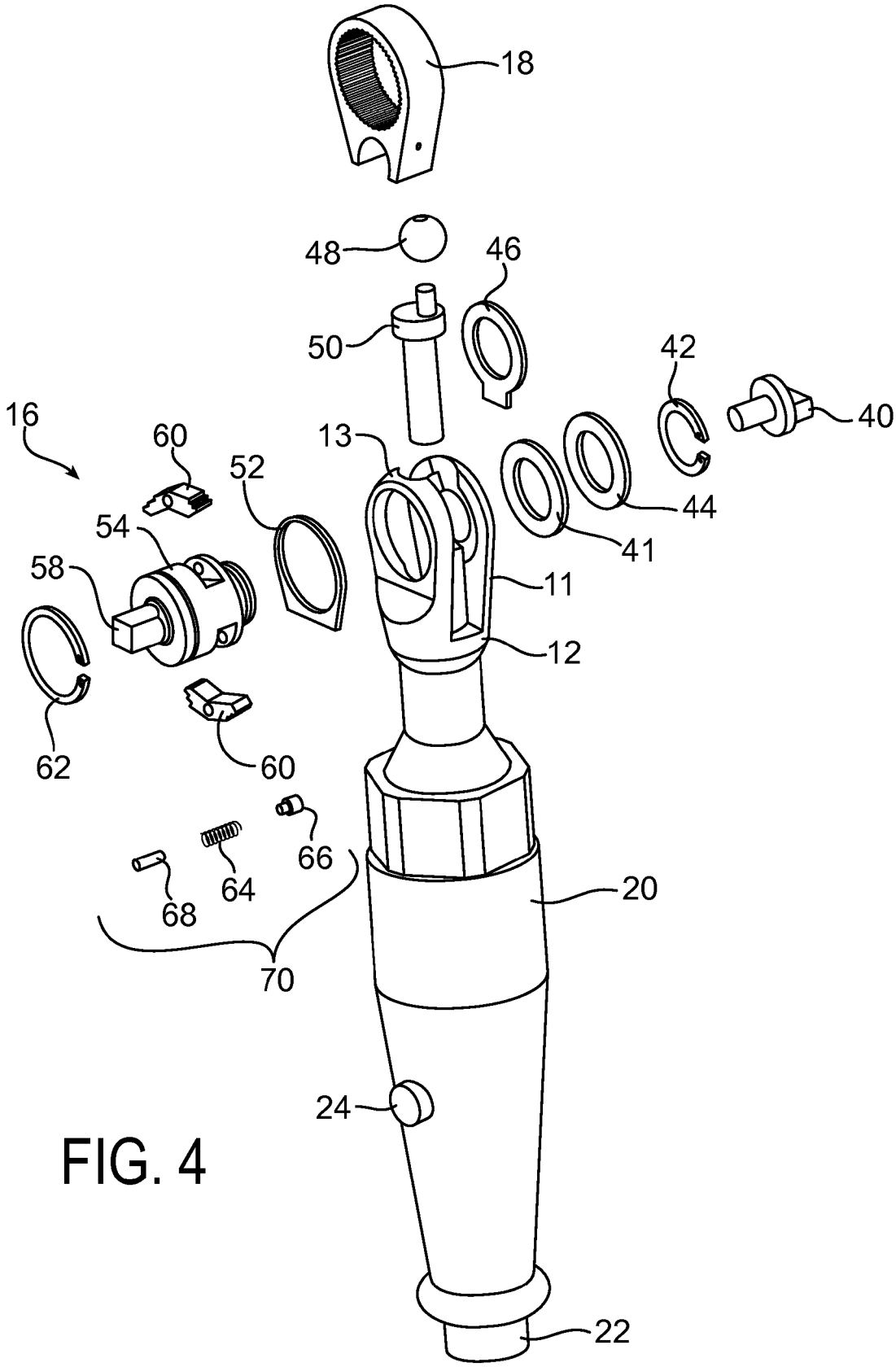
FIG. 4 is an exploded perspective view of the ratchet wrench.
Figure 5:
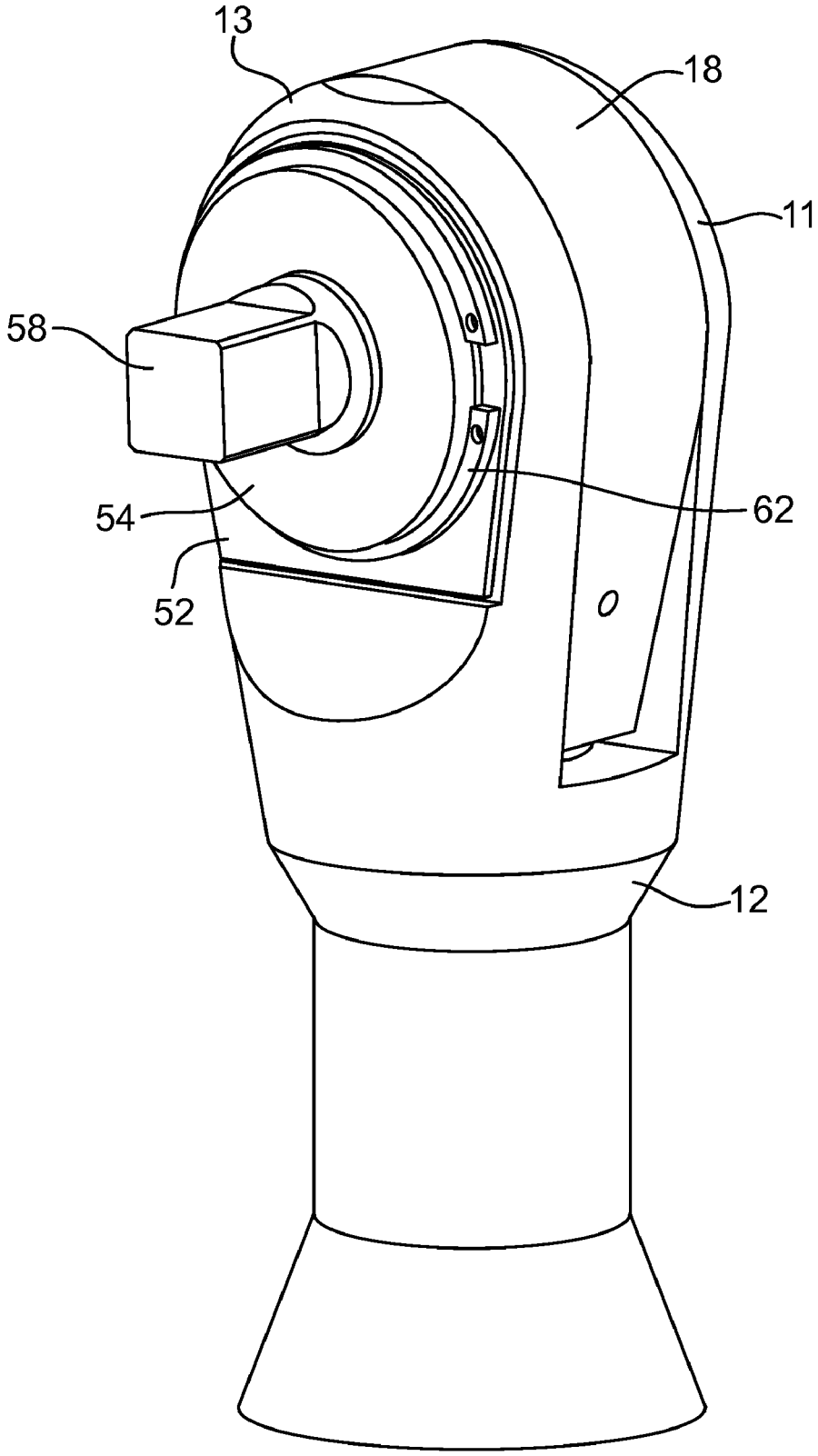
FIG. 5 is a perspective view of the head portion of the ratchet wrench.

As shown in FIGS. 2 and 4, the ratchet mechanism 16 has a drive body 54 having a drive square 58, at least one pawl 60, and a shift lever 40. The shift lever 40 allows for selection of the direction of rotation of the drive body 54, the drive square 58, and any tool affixed to the drive square 58, such as a socket. The ratchet mechanism 16 is positioned at least partially within the yoke 18 to allow for rotation of the drive body 54. As shown in FIGS. 2 through 5, the ratchet mechanism 16 may be retained on one side by a snap ring 62, a wear washer 52, and the second ear 13, and on the other side by a snap ring 42, a wear washer 44, and the first ear 11.

The yoke 18 in the head portion 12 has a plurality of yoke teeth 51, shown in FIG. 4, the teeth formed along the circumference of the yoke 18. A washer such as a Belleville washer 41 or wave washer may be positioned in the head portion 12 adjacent to the yoke 18. Alternately, more than one washer may be positioned in the head portion 12, such as a pair of nested Belleville washers. The Belleville washers positioned in between the drive body 54 and the ears 11, 13 also may provide a portion of the head tension preventing slipping of the ratchet mechanism 16. A nested pair of Belleville washers may be positioned beneath a wear washer to provide a portion of the force or head tension in the head portion 12 as the ratchet wrench 10 undergoes the ratcheting operation.

Referring to FIGS. 2, 3 and 4, the drive body 54 of the ratchet mechanism 16 has at least one pawl 60. The pawl 60 is positioned in the ratchet mechanism 16 so that the pawl 60 is capable of selectively engaging one or more of the teeth 51 of the yoke 18. The yoke 18 reciprocates between a first direction with the pawl 60 operatively engaging one or more of the yoke teeth 51 and a second direction with the pawl 60 disengaged, such that the pawl ratchets over the yoke teeth 51 when the yoke moves in the second direction. A spring assembly 70 is provided capable of retaining the drive body 54 relative to the head portion 12 when the yoke 18 reciprocates with the pawl 60 disengaged from the yoke teeth 51 in the second direction.

Figure 6:
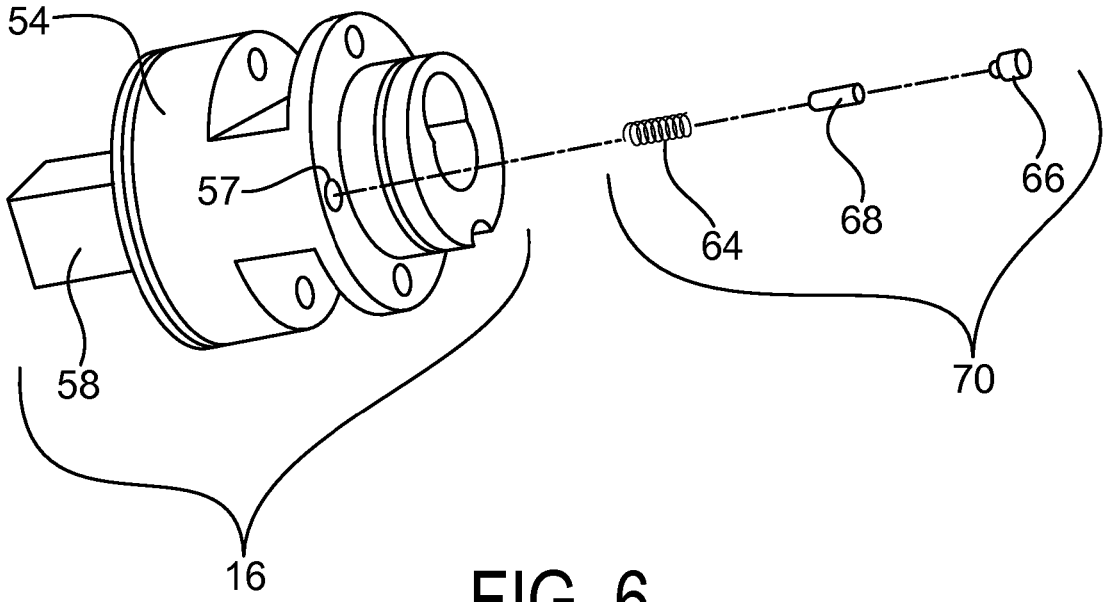
FIG. 6 is an exploded perspective view of the ratchet mechanism and spring assembly.

As shown in FIG. 6, each spring assembly 70 is positioned in a spring aperture 57 in the drive body 54. The spring assembly 70 includes a spring 64 and a stabilizer 68 positioned in the spring aperture 57, and may include a cap 66 located at one end of the spring assembly 70. A wear washer 46 may be positioned between the yoke 18 and the ear 11 to provide a surface engaging the spring assembly 70. The stabilizer is an elastic member cooperatively positioned with the spring 64 to maintain the head tension of the ratchet wrench. The stabilizer 68 may be a second coil spring, a polymer pin or insert, a cylindrical core member, a pin constructed from plastic or metal materials, a polymer sleeve or cylinder, or other elastic member.

Referring to FIGS. 2, 3, and 6, more than one spring assembly 70 may be provided in more than one aperture 57 in the drive body 54, and each spring assembly 70 aligned generally along the drive body 54 axis of rotation. The pawl axis may also be along the axis of rotation of the drive body 54. The stabilizer 68 may be positioned within the spring 64 in each aperture 57. Alternately or in addition, the spring 64 and the stabilizer 68 may have corresponding shapes so that the stabilizer 68 and the spring 64 may be positioned in a nested arrangement. Alternately or in addition, the stabilizer 68 may be positioned adjacent to the spring 64 in the drive body 54 of the ratchet mechanism 16, or may be positioned around the spring 64. When the stabilizer 68 is in the embodiment of a coil spring, the stabilizer 68 is referred to as a second spring and the spring 64 is referred to as a first spring.

The stabilizer 68 may be an elastomeric material such as, but not limited to, polyurethane, rubber, or other elastomer. The stabilizer 68 may be made of an elastomeric material having a Shore A durometer between about 85 and about 102 Shore A. In alternate embodiments, the stabilizer 68 may be made of an elastomeric material having a Shore A durometer between about 92 and about 98 Shore A. The stabilizer 68 may be a cylinder-shaped elastomeric pin that has a diameter corresponding to the inside diameter of the spring 64. In one embodiment, the stabilizer 68 is a cylinder-shaped insert of 95 durometer Shore A polyurethane. We have found that the stabilizer may reduce deformation of the spring assembly 70 during use of the ratchet wrench 10. The reduced deformation of the spring assembly 70 also provides a stable and greater tension force of the ratchet mechanism 16 in between the ears 11, 13 of the yoke 18 and reduces decrease in head tension over the life of the ratchet wrench 10.

As shown in FIG. 3, the spring assembly 70 may include a cap 66 at one end of the spring 64 and the stabilizer 68. The cap 66 may be shaped to engage the spring 64 or the stabilizer 68 at one end. The cap 66 may have a generally flat top and a generally cylindrical shape with a larger diameter on one end and a smaller diameter on the opposite end. In one embodiment, the larger diameter of the cap 66 extends from the spring 64 and lies adjacent to the exterior surface of the drive body 54 when the spring assembly 70 is compressed. The larger diameter end may be generally flat in order to distribute frictional forces over the surface. The smaller diameter of the cap 66 extends into the spring 64 and lies adjacent to or abutting the stabilizer 68. The cap 66 may apply spring force against the inside of the ear 11, and may contact the wear washer 46 as shown in FIG. 3. The cap 66 may have a generally flat top, but the cap 66 is not limited to this particular embodiment. In alternate embodiments, the cap 66 may be constructed from various shaped structures such as, but not limited to, a ball bearing with a rounded surface or other structures with either a flat or rounded surface.

The spring apertures 57 have a depth corresponding to a compressed length of the spring assembly 70 as desired. The apertures 57 may extend substantially through the drive body 54.

In operation as shown in FIG. 4, the drive motor (not shown) causes a crank 50 and an attached drive bushing 48 to rotate. The drive bushing 48 engages the yoke 18 and moves the yoke 18 in a first or predetermined drive direction. The yoke 18 is coupled to the ratchet mechanism 16 by the engagement of the teeth of the pawl 60 with the teeth 51 of the yoke 18. In the first drive direction, the teeth of the pawl 60 engage the teeth 51 of the yoke 18. Continued rotation of the drive bushing 48 moves the yoke 18 in a second drive direction opposite the first direction. This change in direction causes the teeth of the pawl 60 to disengage from, and ratchet over, the teeth 51 of the yoke 18, effectively uncoupling the ratchet mechanism 16 from the yoke 18. While the yoke 18 reciprocates in the second direction, the ratchet mechanism 16 is held in position by the spring assembly 70 and the spring force with respect to the head portion 12.

As the yoke 18 reciprocates between movement in a first direction and movement in a second direction opposite the first direction, the ratchet mechanism 16 turns the drive square 58. The spring assembly 70 holds the ratchet mechanism 16 relative to the head portion as the yoke 18 moves in the second direction. Continued rotation of the crank 50 causes the yoke 18 to reciprocate resulting in rotation of the drive square 58 in the desired direction.

The spring assembly 70 of the present disclosure provides improved head tension force in the head portion of the ratchet wrench between about 45 to 55 lbs throughout the life cycle of the ratchet wrench 10. Additionally, we found that the present spring assembly 70 improves the longevity of the ratchet wrench 10 by reducing the drop of head tension over the life of the ratchet as compared to certain previous ratchet wrenches.

Although the principles, embodiments and operation of the ratchet mechanism in the present disclosure have been described in detail herein, this is not to be construed as being limited to the particular illustrative forms disclosed. They will thus become apparent to those skilled in the art that various modifications of the embodiments herein can be made without departing from the spirit or scope of the ratchet mechanism. Accordingly, the scope and content of the present disclosure are to be defined further by the terms of the following claims.

What is claimed is:

1. A ratchet wrench comprising:

a handle portion;

a head portion operably connected to the handle portion;

a drive body comprising at least one pawl and at least one spring aperture positioned in the head portion;

a yoke comprising a plurality of teeth positioned within the head portion capable of reciprocating between a first direction with the at least one pawl operatively engaging one or more teeth and a second direction with the at least one pawl disengaged from the teeth;

a spring assembly positioned in at least one spring aperture capable of retaining the drive body relative to the head portion when the yoke reciprocates in the second direction with the at least one pawl disengaged from the teeth, the spring assembly comprising:

a spring; and an elastic stabilizer cooperatively positioned with the spring.

2. The ratchet wrench of claim 1, wherein the stabilizer is a coil spring.

3. The ratchet wrench of claim 1, wherein the stabilizer is an elastomeric pin.

4. The ratchet wrench of claim 1, wherein the stabilizer is a polyurethane pin having a durometer between about 85 and 102 Shore A.

5. The ratchet wrench of claim 1, wherein the stabilizer is positioned within the spring.

6. The ratchet wrench of claim 1, wherein the spring assembly further comprises a cap cooperatively positioned with the spring.

7. The ratchet wrench of claim 6, wherein the cap has a flat surface on one end and the flat surface is adjacent to an exterior surface of the drive body when the spring assembly is compressed.

8. A ratchet mechanism for use in a ratchet wrench comprising:

a drive body having an axis of rotation;

one or more axially extending apertures positioned in the drive body;

a spring positioned in at least one aperture; and an elastic stabilizer cooperatively positioned with the spring.

9. The ratchet mechanism of claim 8, wherein the stabilizer is a coil spring.

10. The ratchet mechanism of claim 8, wherein the stabilizer is an elastomeric pin.

11. The ratchet mechanism of claim 8, wherein the stabilizer is a polyurethane pin having a durometer between about 85 and 102 Shore A.

12. The ratchet mechanism of claim 8, wherein the spring assembly further comprises a cap cooperatively positioned with the spring.

13. The ratchet mechanism of claim 12, wherein the cap has a flat surface on one end and the flat surface is adjacent to an exterior surface of the drive body when the spring assembly is compressed.

14. A ratcheting mechanism for use in a ratchet wrench comprising:

a yoke comprising a plurality of teeth, the yoke capable of ratcheting about an axis;

a drive body comprising:

at least one pawl operatively engaging one or more of the yoke teeth to rotate the drive body about the axis;

one or more apertures;

a first spring positioned in at least one aperture;

a second spring cooperatively positioned with the first spring, and a cap located at one end of the first spring.

15. The ratcheting mechanism of claim 14, wherein the second spring is an elastomeric pin.

16. The ratcheting mechanism of claim 15, wherein the elastomeric pin has a shape corresponding to the shape of the first spring.

17. The ratchet mechanism of claim 14, wherein the second spring is a polyurethane pin having a durometer between about 85 and 102 Shore A.

18. The ratcheting mechanism of claim 14, wherein the cap engages the first spring.

19. The ratcheting mechanism of claim 14, wherein the cap has a flat surface on one end and the flat surface is adjacent to an exterior surface of the drive body when the spring assembly is compressed.

20. The ratcheting mechanism of claim 14, wherein the aperture extends substantially through the drive body.

* * * * *